US006612350B1

(12) United States Patent
Brynjulfsen

(10) Patent No.: US 6,612,350 B1
(45) Date of Patent: Sep. 2, 2003

(54) CARRYING CASE HAVING A BENDABLE RIGID SKELETON

(76) Inventor: Edel Maria Brynjulfsen, Másøy vn 6E, 9600 Hammerfest (NO)

( * ) Notice: Subject to any disclaimer, the term of this patent is extended or adjusted under 35 U.S.C. 154(b) by 0 days.

(21) Appl. No.: 10/189,716

(22) Filed: Jul. 3, 2002

(51) Int. Cl.[7] ..... A45C 2/00; A45C 13/04; A45C 13/28

(52) U.S. Cl. ..... 150/118; 150/111; 150/130; 224/231; 224/235; 224/673

(58) Field of Search ..... 150/118, 119, 150/130, 104, 900, 107, 111; 383/33; 190/106; 224/673, 235, 231

(56) References Cited

U.S. PATENT DOCUMENTS

| | | | | | |
|---|---|---|---|---|---|
| 2,116,902 | A | * | 5/1938 | Lehrfeld | 150/900 X |
| D132,694 | S | * | 6/1942 | Appel | 150/118 X |
| 2,653,640 | A | | 9/1953 | Browning | |
| 2,710,639 | A | * | 6/1955 | Farls | 224/673 X |
| 2,779,373 | A | | 1/1957 | Koepke | |
| 2,845,974 | A | * | 8/1958 | Arden | 150/104 |
| 3,234,985 | A | | 2/1966 | Gilbert | |
| 4,739,877 | A | * | 4/1988 | Olson | 150/900 X |
| 4,836,428 | A | * | 6/1989 | Evans et al. | 224/673 |
| 5,009,319 | A | * | 4/1991 | Jantzen | 150/104 X |
| 5,511,704 | A | * | 4/1996 | Linderer | 224/673 |

* cited by examiner

*Primary Examiner*—Sue A. Weaver
(74) *Attorney, Agent, or Firm*—Robert E. Howard

(57) ABSTRACT

A carrying case, such as a purse or fanny pack, having a skeleton formed of a bendable, rigid material. The skeleton has front and rear opposing sidewalls, each having an arcuate shape. The sidewalls are joined along the bottom longitudinal edges thereof and are normally spaced apart along their upper longitudinal edges to form a clamshell shaped configuration. The front sidewall has an inwardly and downwardly extending latching lip formed in its upper longitudinal edge. The upper longitudinal edges of the sidewalls can be closed and latched by squeezing the front and rear sidewalls toward each other and snapping the upper longitudinal edge of the rear sidewall into the lip formed in the upper longitudinal edge of the front sidewall. A fabric cover is pulled over and around the sidewalls of the skeleton. The endwalls of the fabric cover forms the endwalls of the carrying case.

7 Claims, 3 Drawing Sheets

Fig. 6
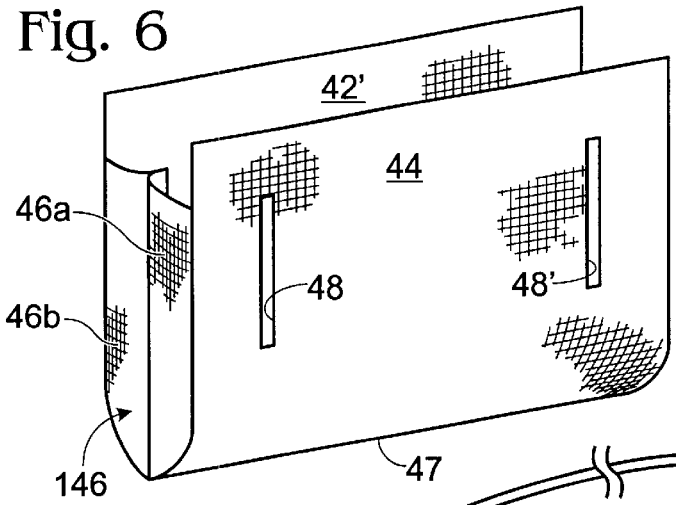
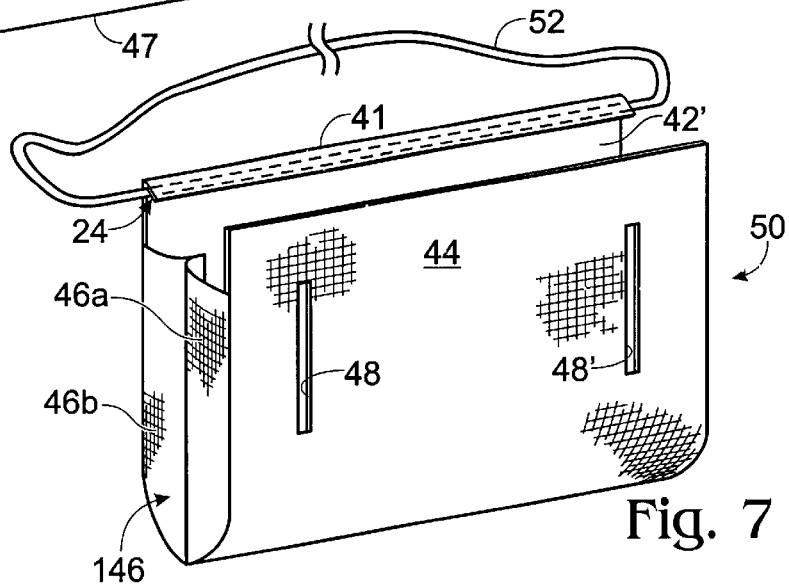
Fig. 7
Fig. 8
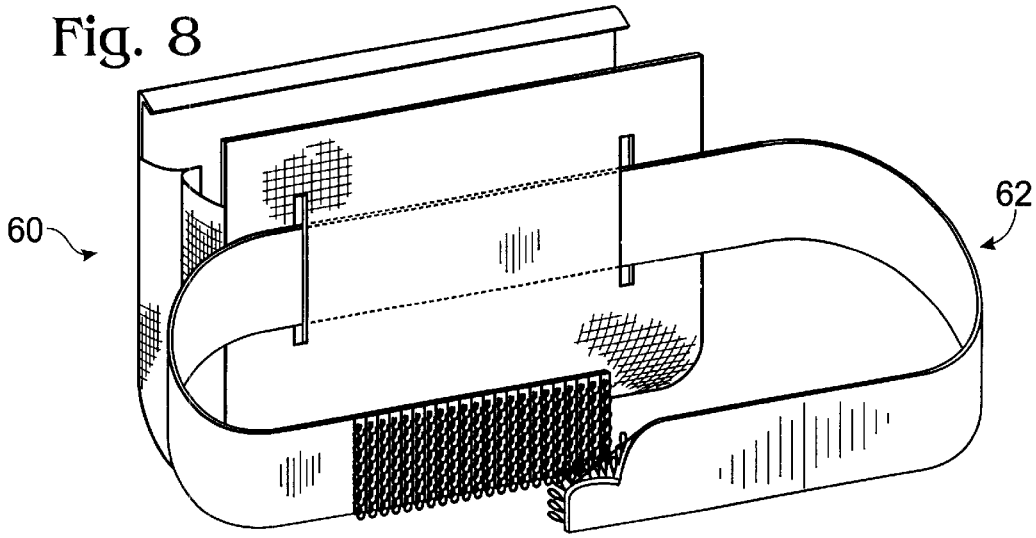

CARRYING CASE HAVING A BENDABLE RIGID SKELETON

BACKGROUND OF THE INVENTION

The present invention relates to a carrying case, such as a purse or fanny pack, having a bendable, rigid skeleton enclosed by a removable cover.

The rigid skeleton protects the contents carried inside the purse or fanny pack.

The removable cover allows the cover to be cleaned, or removed to substitute a cover having a different design.

SUMMARY OF THE PRESENT INVENTION

The carrying case of the present invention has a skeleton formed of a bendable, rigid material, such as stainless steel, spring steel, plastic, etc. The skeleton has front and rear opposing sidewalls, each having an arcuate shape, with the inner surfaces thereof being concave. The sidewalls are joined along the bottom longitudinal edges thereof and are normally spaced apart along their upper longitudinal edges to form a clamshell-shaped configuration. The normally spaced apart upper longitudinal edges form an opening in communication with the interior space formed between the clamshell sidewalls. The front sidewall has an inwardly and downwardly extending latching lip formed in its upper longitudinal edge. The upper longitudinal edges of the sidewalls can be closed and latched by squeezing the front and rear sidewalls toward each other and snapping the upper longitudinal edge of the rear sidewall into the latching lip formed in the upper longitudinal edge of the front sidewall.

A stretchable fabric cover, such as one made of neoprene, is pulled over and around the sidewalls of the skeleton. The endwalls of the fabric cover forms the endwalls of the purse or fanny pack.

BRIEF DESCRIPTION OF THE DRAWINGS

FIG. 6 is a rear perspective view of the fabric covering, shown in its assembled state;

FIG. 7 is a rear perspective view of the carrying case of the present invention with the fabric covering shown in place over the skeleton, the carrying case being shown in its open configuration; and FIG. 8 is a rear perspective view of the fanny pack of the present invention with the fabric covering shown in place over the skeleton and a waist belt in place, the fanny pack being shown in its open configuration.

DESCRIPTION OF PREFERRED EMBODIMENTS

Figure 1:
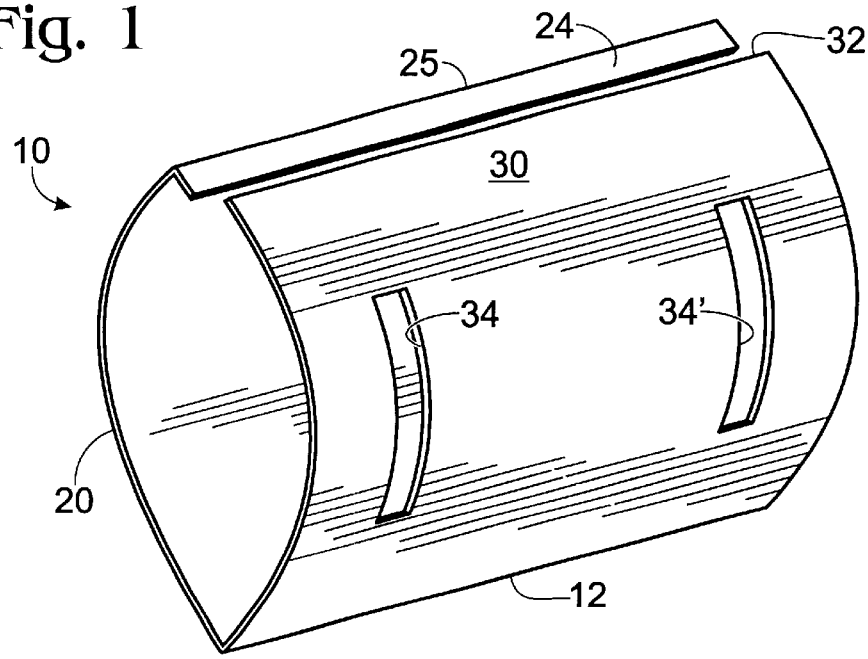
FIG. 1 is a rear perspective view of the skeleton of the carrying of the present invention, shown in the open configuration.

The carrying case of the present invention has a skeleton 10 formed of a bendable, rigid material, such as stainless steel, spring steel, plastic, etc. The skeleton 10 has front and rear opposing sidewalls 20 and 30, respectively, each of said sidewalls having an arcuate shape.

Front sidewall 20 has an upper longitudinal edge 22 which is bent inwardly and downwardly from the main body portion of sidewall 20 along bend line 25 to form a latching lip 24. Latching lip 24 is at an angle less than 90 degrees to a tangent passing through the portion of sidewall 20 immediately adjacent bend line 25.

Rear sidewall 30 has an upper longitudinal edge 32.

Skeleton 10 is preferably formed of a single rectangular sheet of a metal substrate, such as stainless steel, spring steel, etc., which is bent substantially at its mid-section to form a common (integral) lower longitudinal edge 12 for sidewalls 20 and 30 and bent to form the arcuate shape of sidewalls 20 and 30. The metal substrate is bent only to the extent shown in FIGS. 1 and 2 with lip 24 of front sidewall 20 being spaced apart from upper longitudinal edge 32 of rear sidewall 30 to form an clamshell shaped structure having an opening communicating with the interior space between the sidewalls 20 and 30. In the open position shown in FIGS. 1 and 2, the substrate forming skeleton 10 is in an unstressed condition.

Figure 3:
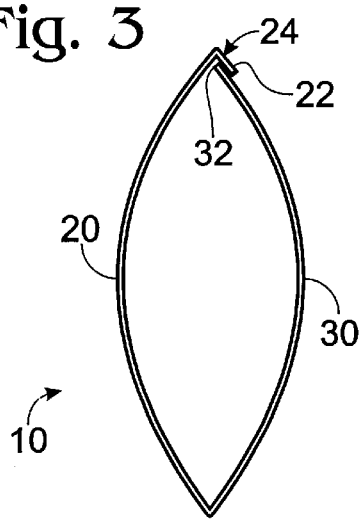
FIG. 3 is a right end view of the skeleton of the carrying case of the present invention, shown in its closed and latched configuration.

Skeleton 10 can be closed to the position shown in FIG. 3 by squeezing front sidewall 20 and rear sidewall 30 towards each other, and squeezing longitudinal edge 32 of rear sidewall 30 under latching lip 24 of front sidewall 20, which forces latching lip 24 upwardly a sufficient distance to allow longitudinal edge 32 to be snapped into place under latching lip 24. In the closed and latched configuration shown in FIG. 3, the substrate forming sidewalls 20 and 30 is under a bending stress which causes longitudinal edge 32 to push upwardly against the underside of latching lip 24 and latching lip 24 to push downwardly against the upper side of longitudinal edge 32 to thereby hold the skeleton structure in the closed and latched configuration shown in FIG. 3.

Figure 2:
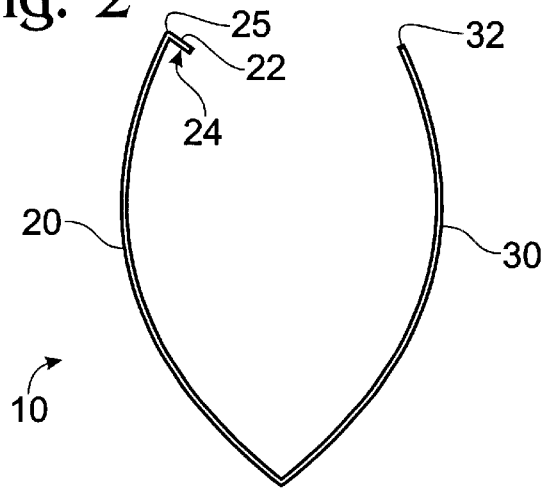
FIG. 2 is a right end view of the skeleton of the carrying case of the present invention shown in the open configuration of FIG. 1.

From the closed and latched position shown in FIG. 3, skeleton 10 can be unlatched and opened to the open configuration shown in FIGS. 1 and 2 by pulling latching lip 24 and rear sidewall 30 apart, whereupon the substrate forming skeleton 10 returns to its unstressed configuration, thereby returning sidewalls 20 and 30, and lip 24 to the configuration shown in FIGS. 1 and 2.

Although a metal, such as stainless steel or spring steel, is preferred as the substrate from which skeleton 10 is formed, skeleton 10 can be made from an injection molded plastic having the stressed/unstressed properties discussed above relative to latching lip 24 and sidewalls 20 and 30.

Rear sidewall 30 has a pair of spaced apart belt slots 34 and 34', adapted to receive a belt where the carrying case is to be used as a fanny pack, as will be discussed below.

A decorative fabric cover 40 is designed to be removably placed over the outside of the skeleton 10.

The fabric cover is preferably made of a stretchable material, such as neoprene, in order to allow it to be pulled over skeleton 10 more easily.

Figure 4:
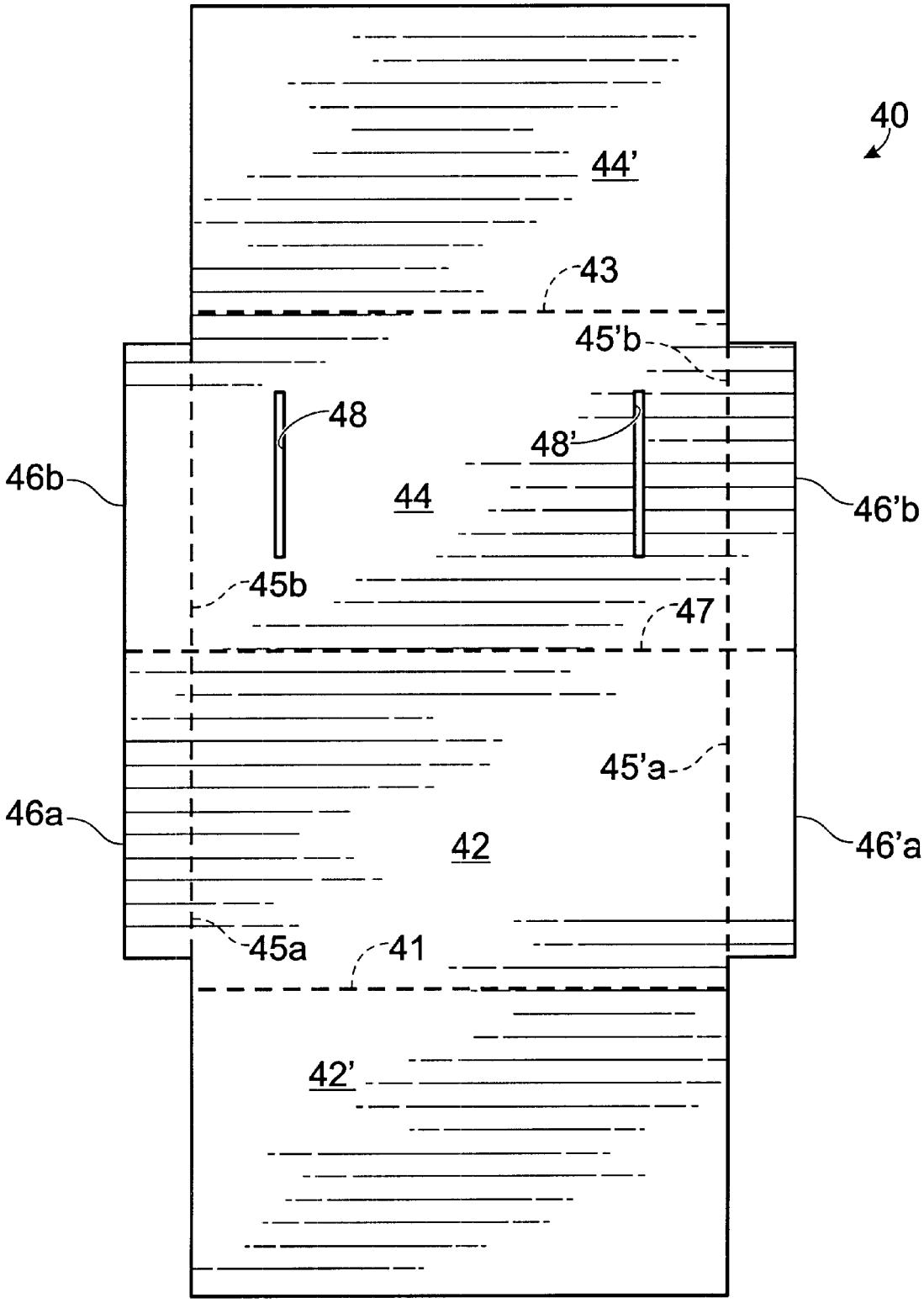
FIG. 4 is a top plan view of the pattern for the fabric covering for the carrying case of the present invention.

FIG. 4 shows the pattern used for forming cover 40. Dotted line 41 represents a fold line between outer front panel 42 and inner front panel 42'. Dotted line 43 represents a fold line between outer rear panel 44 and inner rear panel 44'.

Outer rear panel 44 has two belt slots 48, 48' of a size and location such that they are in registration with belt slots 34 and 34' of skeleton 10 when cover 40 is positioned over skeleton 10.

Dotted line 45*a* represents a fold line between right end panel 46*a* and outer front panel 42. Dotted line 45*b* represents a fold line between right end panel 46*b* and outer rear panel 44. Dotted line 45'*a* represents a fold line between left end panel 46'*a* and outer front panel 42. Dotted line 45'*b* represents a fold line between left end panel 46'*b* and outer rear panel 44. "Right" and "left" refer to the positions of end panels 46 and 46' when fully assembled cover 40 encloses skeleton 10 and with the viewer facing outer front panel 42.

In assembling cover 40, inner front panel 42' is folded back against outer front panel 42 along fold line 41, i.e., into and behind the plane of FIG. 4 and away from the viewer. Inner front panel 42' is shorter than outer front panel 42, and the outer edge of inner front panel 42' does not extend all the way to bottom fold line 47.

Similarly inner rear panel 44' is folded back against the outer rear panel 44, i.e., into and behind the plane of FIG. 4 and away from the viewer. Inner rear panel 44' is shorter than outer rear panel 44, and the outer edge of inner rear panel 44' does not extend all the way to bottom fold line 47.

Outer and inner front panels. 42 and 42', and outer and inner rear panels 44 and 44' are joined along both side edges, such as by sewing.

Figure 5:
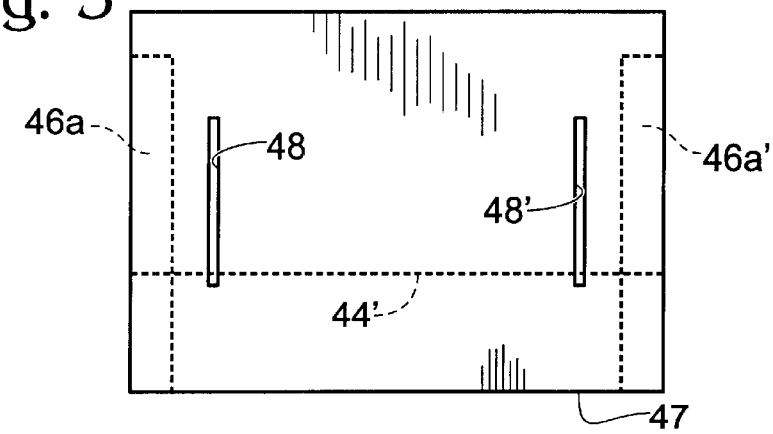
FIG. 5 is a rear elevation view, partially in cross-section, of the fabric covering, shown in its assembled state.

Next, one of outer front panel 42 or outer rear panel 44 of the thus sewn subassembly is folded along fold line 47 by raising it upwardly out of the plane of FIG. 4, i.e., towards the viewer, and downward into contact with the other panel. In this position, right and left endpanels 46 and 46' have been folded about fold line 47 with the outer edge of right endpanel 46*a* being in contact with the outer edge of right endpanel 46*b*, and with the outer edge of left endpanel 46'*a* being in contact with the outer edge of left endpanel 46'*b*. The outer edges of the right endpanels 46*a* and 46*b* and the outer edges of left endpanels 46'*a* and 46'*b* are then joined together, such as by sewing. Cover 40 is then reversed (turned inside out) to form the cover configuration shown in FIGS. 5 and 6. As can be seen, joined right endpanels 46*a* and 46*b* form a right endwall 146 in cover 40. Joined left end panels 46'*a* and 46'*b* form a left endwall (not shown) in cover 40, the left endwall being identical to right endwall 146.

Cover 40, made of a stretchable fabric, is then pulled over skeleton 10 with front wall 20 of skeleton 10 fitting between outer front panel 42 and inner front panel 42' of cover 40 and with rear wall 30 of skeleton 10 fitting between outer rear panel 44 and inner rear panel 44' of cover 40. Once the cover is in place, belt slots 34 and 34' of rear wall 30 of skeleton 10 are in alignment with belt slots 48 and 48' of cover 40.

FIG. 7 shows the carrying case of the present invention being used as a purse 50 with cover 40 positioned over skeleton 10. Purse 50 is shown in the open position with the fabric of cover 40 adjacent fold line 41 stretching over lip 24. Right endwall 146 of cover 40 forms the right endwall of purse 50 and left endwall of cover 40 (not shown) forms the left endwall of purse 50.

Where purse 50 is to be used as an over-the-shoulder style, a strap 52 can be inserted between lip 24 and that portion of inner front panel 42' that extends over lip 24, the stitching of inner front panel 42' to outer front panel 42 being omitted at the area adjacent the ends of lip 24 to allow strap 52 to pass therethrough.

Where purse 50 is to be used as a held-in-hand purse, strap 52 can be removed.

FIG. 8 shows the carrying case of the present invention being used as a fanny pack 60. In use as a fanny pack, a belt 62 passes between the inner surface of rear wall 30 of skeleton 10 and the inner surface of inner rear panel 44' of cover 40, exits belt slots 34, 34' of skeleton 10 and belt slots 48, 48' of cover 40. The outer ends of belt 62 can be fastened together by any suitable fastening means, such as a buckle, use of a hook and loop fastener material, or other fastening means. Where a hook and loop fastener arrangement is used, as shown in FIG. 8, one side of belt 62 has either the hook or loop portion of a hook and loop fastening material and the other side of belt 62 has the opposite portion so that belt 62 can be adjusted snugly about the waist of a user and fastened together with the hook and loop fastener material.

Purse 50 or fanny pack 60 is closed by pushing the rear wall 30 toward front wall 20 and snapping the covered outer longitudinal edge 32 under covered lip 24, which bends slightly backward to receive longitudinal edge 32, thereby latching the purse or fanny pack into the locked configuration shown in FIG. 3. By "covered lip" is meant lip 24 as covered by cover 40, as shown in FIG. 7 or 8. To unlatch, sidewall 30 is pushed downwardly away from lip 24 to release longitudinal edge 32 from lip 24, thereby allowing sidewalls 20 and 30 to springingly return to their unstressed, open configuration shown in FIGS. 1 and 2.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A carrying case comprising:

a skeleton formed of a bendable, rigid material, said skeleton having front and rear opposing sidewalls, each of said sidewalls having an upper longitudinal edge and a lower longitudinal edge, said sidewalls being joined at said lower longitudinal edge, said sidewalls being spaced apart at said upper longitudinal edges when said skeleton is in an unstressed condition, each of said sidewalls having a concave inner surface, one of said front and rear sidewalls having a lip formed therein along substantially the entire length of its upper longitudinal edge, said lip adapted to receive and latchingly retain substantially the entire length of said upper longitudinal edge of the other of said front and rear sidewalls when said sidewalls are pushed towards each other; and a fabric cover positioned over said skeleton, said fabric cover having right and left endwalls which form the endwalls of said carrying case.

2. The carrying case of claim 1 wherein said fabric cover is formed of a stretchable fabric.

3. The carrying case of claim 2 wherein said fabric is neoprene.

4. The carrying case of claim 1 wherein one of said front and rear opposing sidewalls of said skeleton has a pair of substantially parallel belt slots extending therethrough and that portion of said fabric cover extending over said one of said front and rear opposing sidewalls has a pair of substantially parallel belt slots extending therethrough and substantially in registration with said belt slots extending through said sidewall.

5. The carrying case of claim 4 including a belt having a mid-portion and outer ends, the mid-portion of said belt extending through said slots in said sidewall and said slots extending through said fabric cover, the outer ends of said belt having adjustable fastening means thereon to allow said belt to be stretched around the waist of a user and fastened.

6. The carrying case of claim 5 wherein said fastening means is hook and loop fastening material.

7. A carrying case comprising:

a skeleton formed of a bendable, rigid material, said skeleton having front and rear opposing sidewalls, each of said sidewalls having an upper longitudinal edge and a lower longitudinal edge, said sidewalls being joined at said lower longitudinal edge, said sidewalls being spaced apart at said upper longitudinal edges when said skeleton is in an unstressed condition, each of said sidewalls having a concave inner surface, one of said front and rear sidewalls having a lip formed therein along substantially the entire length of its upper longitudinal edge, said lip adapted to receive and latchingly retain substantially the entire length of said upper longitudinal edge of the other of said front and rear sidewalls when said sidewalls are pushed towards each other;

a fabric cover positioned over said skeleton, said fabric cover having right and left endwalls which form the endwalls of said carrying case; and a shoulder strap extending behind said lip.

* * * * *